US009079069B1

(12) United States Patent
Mendelsohn

(10) Patent No.: US 9,079,069 B1
(45) Date of Patent: Jul. 14, 2015

(54) WHEELCHAIR ACCESSIBLE FITNESS EQUIPMENT

(71) Applicant: Greenfields Outdoor Fitness, Inc., Santa Ana, CA (US)

(72) Inventor: Sam Mendelsohn, Santa Ana, CA (US)

(73) Assignee: Greenfields Outdoor Fitness, Inc., Santa Ana, CA (US)

( * ) Notice: Subject to any disclaimer, the term of this patent is extended or adjusted under 35 U.S.C. 154(b) by 167 days.

(21) Appl. No.: 14/051,374

(22) Filed: Oct. 10, 2013

Related U.S. Application Data

(60) Provisional application No. 61/712,237, filed on Oct. 10, 2012.

(51) Int. Cl.

| | |
|---|---|
| ***A63B 21/068*** | (2006.01) |
| ***A63B 21/062*** | (2006.01) |
| ***A63B 21/08*** | (2006.01) |
| ***A63B 21/06*** | (2006.01) |
| ***A63B 21/00*** | (2006.01) |

(52) U.S. Cl.
CPC ..... *A63B 21/062* (2013.01); *A63B 21/0615* (2013.01); *A63B 21/08* (2013.01); *A63B 21/1492* (2013.01); *A63B 21/159* (2013.01); *A63B 2021/0623* (2013.01); *A63B 2021/0626* (2013.01)

(58) Field of Classification Search
CPC ..... A63B 21/00003; A63B 21/00032; A63B 21/00047; A63B 21/00101; A63B 21/0012; A63B 21/00123; A63B 21/00185; A63B 21/0615; A63B 21/062; A63B 21/08; A63B 21/1488; A63B 21/1492; A63B 21/15; A63B 21/159; A63B 21/16; A63B 21/1681; A63B 2021/0623; A63B 2021/0626; A63B 23/1254
See application file for complete search history.

(56) References Cited

U.S. PATENT DOCUMENTS

| | | | | | |
|---|---|---|---|---|---|
| 3,116,062 | A * | 12/1963 | Zinkin | ..... | 482/98 |
| 3,917,262 | A * | 11/1975 | Salkeld | ..... | 482/98 |
| 4,911,435 | A * | 3/1990 | Johns | ..... | 482/137 |
| 5,100,128 | A * | 3/1992 | Mabry et al. | ..... | 482/134 |
| 5,277,685 | A * | 1/1994 | Gonzales | ..... | 482/134 |
| 5,304,107 | A * | 4/1994 | Jones | ..... | 482/98 |
| 5,807,219 | A * | 9/1998 | Webber et al. | ..... | 482/134 |
| 8,523,744 | B2 * | 9/2013 | Hongo et al. | ..... | 482/131 |
| D723,635 | S * | 3/2015 | Mendelsohn | ..... | D21/662 |
| 2014/0336017 | A1 * | 11/2014 | Staten et al. | ..... | 482/98 |

* cited by examiner

*Primary Examiner* — Oren Ginsberg
(74) *Attorney, Agent, or Firm* — Eric Karich; Karich & Associates

(57) ABSTRACT

Fitness equipment has a wheelchair space, a base, a frame assembly, an arm assembly, and a resistance. The base, the frame assembly, and the arm assembly do not extend into the wheelchair space. The arm assembly extends from the frame assembly into or adjacent a user space above the wheelchair space, such that a user in the wheelchair can reach the arm assembly. The resistance is attached to the arm assembly for providing resistance to movement of the arm assembly during exercise.

9 Claims, 8 Drawing Sheets

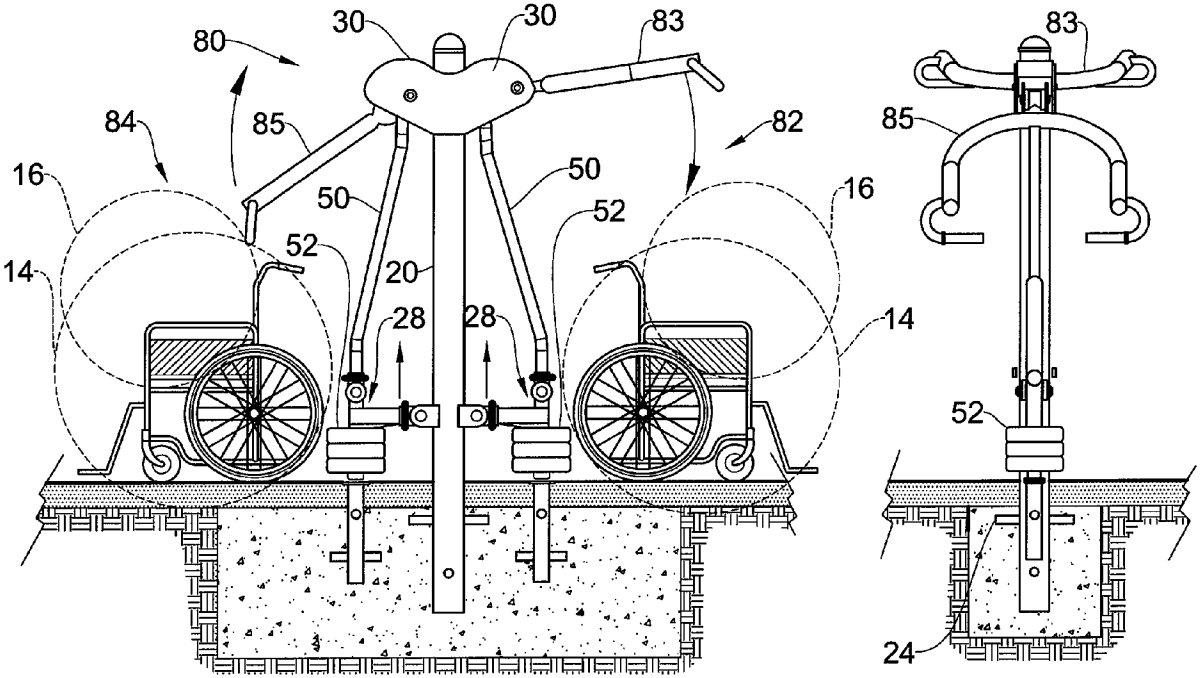
Fig. 11
Fig. 10
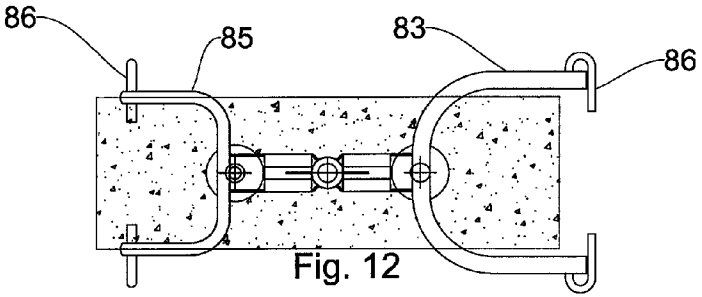
Fig. 12

WHEELCHAIR ACCESSIBLE FITNESS EQUIPMENT

CROSS-REFERENCE TO RELATED APPLICATIONS

This application for a utility patent claims the benefit of U.S. Provisional Application No. 61/712,227, filed Oct. 10, 2012.

BACKGROUND OF THE INVENTION

1. Field of the Invention

This invention relates generally to fitness equipment, and more particularly to fitness equipment that is adapted for use in outdoor exercise areas, and is particularly adapted to accommodate use by people in wheelchairs.

2. Description of Related Art

Fitness equipment as found in gyms, recreational rooms, and outdoor parks is broad well known in the art. However, the devices found in such places cater to users which are not in wheelchairs. Users in wheelchairs are generally unable to use common fitness equipment for several reasons. For one, the limitation of getting into the proper position while in a wheelchair, due to obstructions by the seat or other hardware that non-wheelchair users use. Another limitation is that machines for non-wheelchair users are often designed for users to perform exercises in a standing position. A user in a wheelchair is therefore unable to reach the bars or handles, and even if they were able to would most likely not be able to perform the exercise properly. The present invention fulfills these needs and provides further advantages as described in the following summary.

SUMMARY OF THE INVENTION

The present invention teaches certain benefits in construction and use which give rise to the objectives described below.

The present invention provides fitness equipment installed in or on a ground surface for enabling an exercise by a user in a wheelchair. The fitness equipment has a base installed in or on the ground surface adjacent a wheelchair space that is suitable for a user in a wheelchair. There is a frame assembly supported by the base such that the frame assembly does not extend into the wheelchair space. There is an arm assembly extending from the frame assembly into or adjacent a user space above the wheelchair space, such that the arm assembly does not extend into the wheelchair space, but such that the user in the wheelchair can reach the arm assembly. The fitness equipment also has a resistance attached to the arm assembly for providing resistance to movement of the arm assembly, so that the user may perform an exercise activity using the arm assembly while sitting in the wheelchair.

BRIEF DESCRIPTION OF THE DRAWING

The accompanying drawings illustrate the present invention. In such drawings:

FIG. 10 is a side elevational view of a fourth embodiment of fitness equipment according to the present invention, wherein the fitness equipment is in the nature of a combination lateral pulldown system and a vertical press;

FIG. 11 is a rear elevational view thereof;

FIG. 12 is a top plan view thereof;

DETAILED DESCRIPTION OF THE INVENTION

Figure 2:
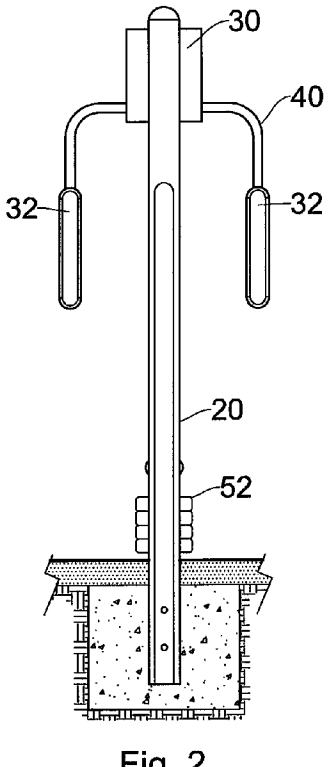
FIG. 2 is a rear elevational view thereof.

The above-described drawing figures illustrate the invention, fitness equipment 10 which is constructed for installation and use outdoors, and is particularly adapted to be wheelchair accessible.

As illustrated in the drawings, and described in greater detail below, each embodiment of the fitness equipment 10 includes a base 20 that is adapted to support the fitness equipment 10 on a ground surface 12. The base 20 supports a frame assembly 30 that is particularly adapted to enable use of the fitness equipment 10 by a user in a wheelchair. The fitness equipment 10 of this invention is designed to not extend into a wheelchair space 14 adjacent the base 20, but leaves the wheelchair space 14 open so that the wheelchair may be parked adjacent the base 20 while the user in the wheelchair uses the fitness equipment 10.

The frame assembly 30 supports an arm assembly 40 which may be positioned in or adjacent to a user space 16 above or around the wheelchair space 14, where the arm assembly 40 may be reached by a user sitting in the wheelchair. In this manner, the arm assembly 40 does not extend into the wheelchair space 14 (blocking the wheelchair), but does extend above it or adjacent to it for use by the user in the wheelchair for performing an exercise activity. Various embodiments of this construction are illustrated in the drawings and described in greater detail below.

Figure 1:
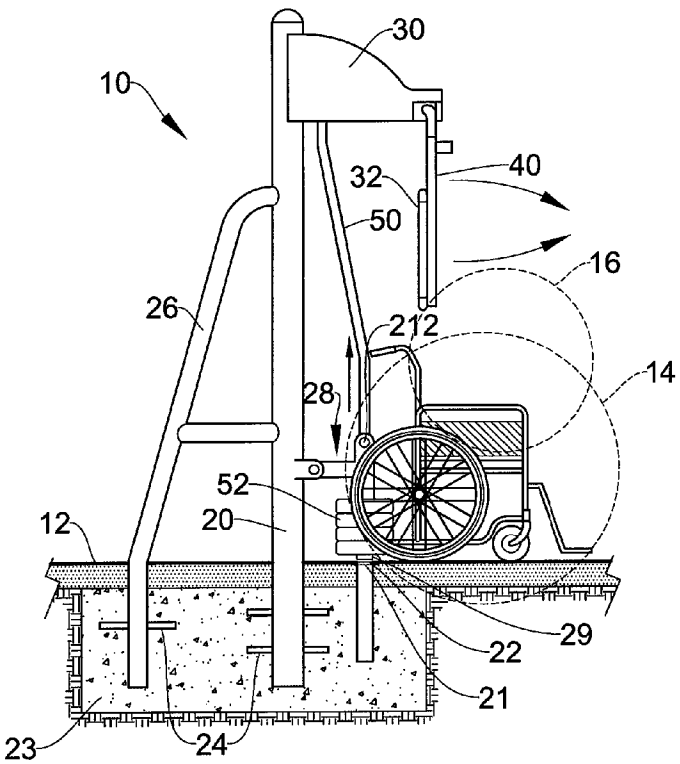
FIG. 1 is a side elevational view of a first embodiment of fitness equipment according to the present invention, wherein the fitness equipment is in the nature of a butterfly press.

FIG. 1 is a side elevational view of a first embodiment of the fitness equipment 10 according to the present invention, wherein the fitness equipment 10 is in the nature of a butterfly press. FIG. 2 is a rear elevational view thereof, and FIG. 3 is a top plan view thereof.

Figure 3:
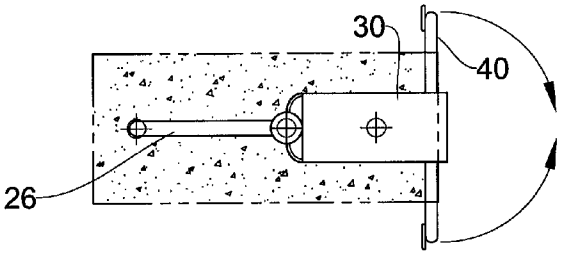
FIG. 3 is a top plan view thereof.

As illustrated in FIGS. 1-3, the fitness equipment 10 includes the base 20, which in this embodiment may be a post that may be planted into the ground surface 12, in this case into a foundation 23 made of cement or other suitable material or structure. In alternative embodiments, the base 20 may be a suitable solid structure that is not set into the ground surface 12 (i.e., a mobile mounting system, not illustrated), or which may be installed into the ground surface 12 using alternative methods known in the art.

The base 20 may further include additional structures that enhance the stability of the base 20. For example, lateral supports 24 may extend from the base 20 (i.e., post) into the cement foundation. A bracing member 26 may extend from the base 20 so provide lateral support. The bracing member 26 may rest on or be mounted into the ground surface 12, to support the base 20.

As discussed above, the frame assembly 30 extends around the wheelchair space 14 adjacent the base 20, but does not extend into the wheelchair space 14, thereby leaving room adjacent the base 20 to park the wheelchair.

The arm assembly 40 extends into or adjacent the user space 16, above the wheelchair space 14, so that it may be readily grasped by the user for performing the exercises, without entering into the wheelchair space 14 (and blocking the proper positioning of the wheelchair within the wheelchair space 14). In the present embodiment, the base 20 extends upwardly to a height that may be well above the height of the user in the wheelchair, and the frame assembly 30 extends outwardly from the base 20. The arm assembly 40, an elongated tubular transmission 50, and a weight stack 52 are further described in the discussion of FIG. 21, below. The arm assembly may include vertical pads 32, for performing the exercise of the present embodiment.

The weight stack 52 is a weighted object for providing resistance to the exercise. It may be in any shape, although in the prevent embodiment is resembles weights such as are commonly used, so that they may be recognizable to the user. The weight stack 52 may be a single weight, or in an alternative embodiment (not shown) it may be adjustable (e.g., using a pin, such as is commonly used in the art). The weight stack 52 may include a cap 29, which may be connected to the end of the weight stack 52 which contacts the ground, or in the present embodiment, a stop post 21 having a stop post cap 22. The stop post 21 may be for providing a durable resting position for the movable weight stack 52. The stop post 21 may be made of a variety of materials, similar to the base 20, and may be implanted in the foundation 23 such that the stop post cap 22 is generally flush with the surface of the foundation 23. The weight stack 52, may be part of a weight stack assembly 28.

As the arm assembly 40 is actuated, in this case to bring the arms of the arm assembly 40 together as shown by the arrows in FIG. 1 and FIG. 3, this motion is converted within the frame assembly 30 to actuate the elongated tubular transmission 50 in an upward motion, lifting the weight stack 52.

Figure 5:
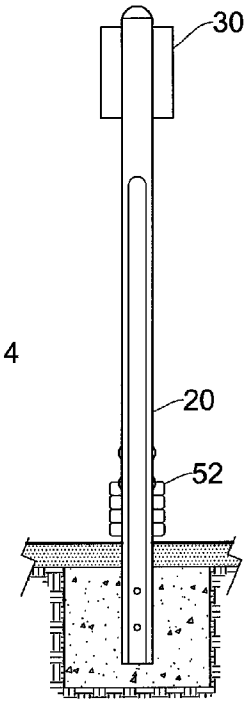
FIG. 5 is a rear elevational view thereof.
Figure 4:
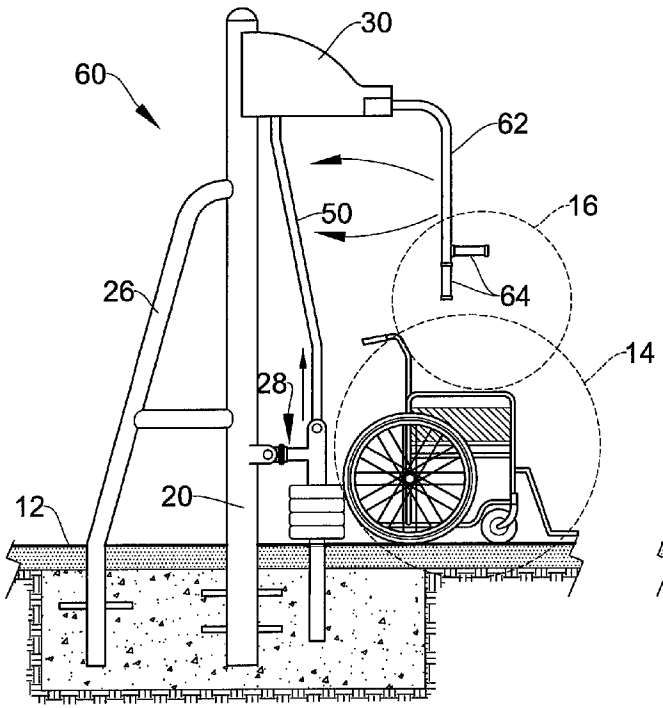
FIG. 4 is a side elevational view of a second embodiment of fitness equipment according to the present invention, wherein the fitness equipment is in the nature of a reverse butterfly press.
Figure 6:
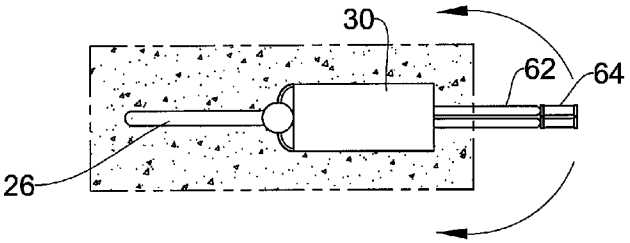
FIG. 6 is a top plan view thereof.

FIG. 4 is a side elevational view of a second embodiment of fitness equipment 60 according to the present invention, wherein the fitness equipment 60 is in the nature of a reverse butterfly press. FIG. 5 is a rear elevational view thereof; FIG. 6 is a top plan view thereof. As illustrated in FIGS. 4-6, the fitness equipment 60 of this embodiment is generally similar to the previous embodiment; however, in this embodiment, an arm assembly 62 is shaped and positioned to form a reverse butterfly press. The arm assembly 62, the elongated tubular transmission 50, and the weight stack 52 are very similar to that described in the discussion of FIG. 21, below. The arm assembly 62 may include L-shaped tubular grasping elements 64, for performing the exercise of the present embodiment.

As the arm assembly 62 is actuated to bring the arms of the arm assembly 62 apart as shown by the arrows in FIG. 4 and FIG. 6, this motion is translated within the frame assembly 30 to actuate the elongated tubular transmission 50 in an upward motion, lifting the weight stack 52. The weight stack 52, may be part of the weight stack assembly 28.

Figure 8:
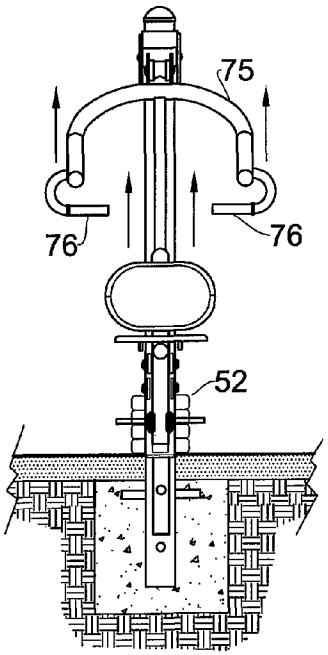
FIG. 8 is a front elevational view thereof.
Figure 7:
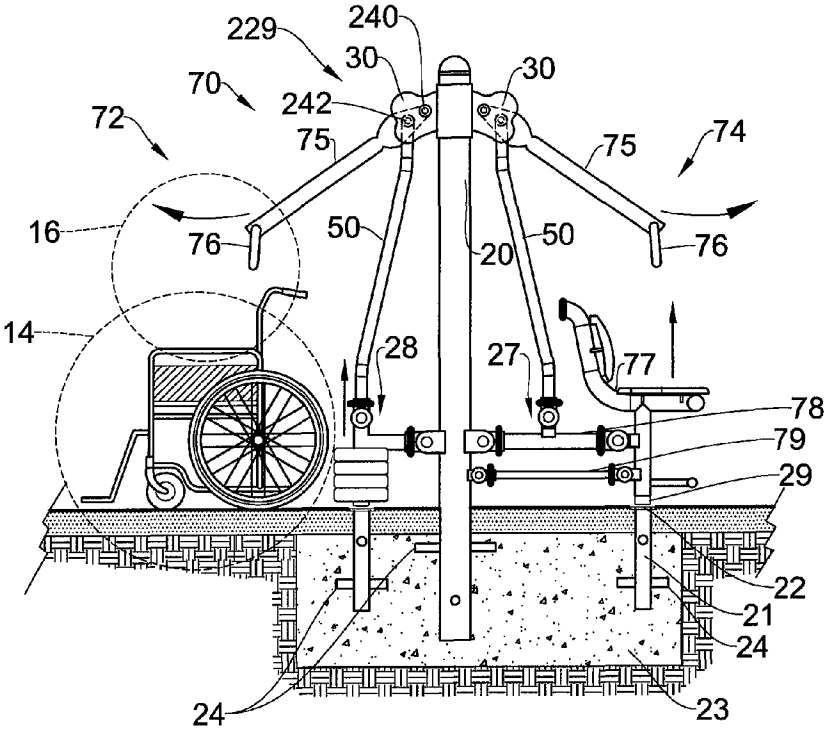
FIG. 7 is a side elevational view of a third embodiment of fitness equipment according to the present invention, wherein the fitness equipment includes a first side that is adapted to be used by a user in a wheelchair, and a second side that is adapted to be used by a person not in a wheelchair, and wherein the fitness equipment is in the nature of a vertical press.
Figure 9:
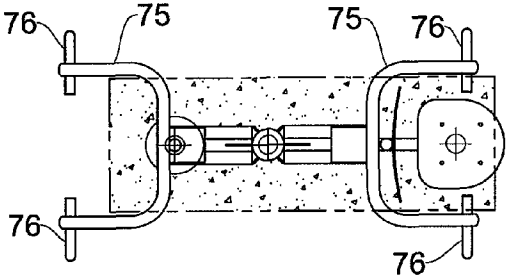
FIG. 9 is a top plan view thereof.

FIG. 7 is a side elevational view of a third embodiment of fitness equipment 70 according to the present invention, wherein the fitness equipment 70 is in the nature of a vertical press. FIG. 8 is a front elevational view thereof and FIG. 9 is a top plan view thereof. As illustrated in FIGS. 7-9, in this embodiment the fitness equipment 70 includes a first side 72 that is adapted to receive the wheelchair, and a second side 74 that is adapted for use by a user who is not in a wheelchair. The bracing member 26 of the first embodiment is not appropriate in this embodiment as it would enter into the wheelchair space 14. Instead the lateral supports 24 are positioned on the portions of the base 20, which extends into the foundation 23.

In the embodiment of FIGS. 7-9, the first side 72 includes an arm assembly 75 that is shaped and positioned to form a vertical press. The arm assembly 75 extends into or adjacent the user space 16, above the wheelchair space 14, so that it may be readily grasped by the user for performing the exercises, without entering into the wheelchair space 14 (and blocking the proper positioning of the wheelchair within the wheelchair space 14). The user in the wheelchair lifts upward on the arm assembly 75 of the first side 72, as shown by the arrows in FIG. 7, with the elongated tubular transmission 50 lifting up when the user pushes up on the arm assembly 75. This generally vertical motion pulls upwards on the weight stack 52. The arm assembly 75, the elongated tubular transmission 50, and weight stack 52 are very similar to that described in the discussion of FIG. 21, below. The weight stack 52, may be part of the weight stack assembly 28 for a user in a wheelchair. The arm assembly 75 may include U-shaped tubular grasping elements 76, for performing the exercise of the present embodiment.

The second side 74 includes a seat 77 which may be shaped and positioned to support the user for performing the vertical press exercise, an upper pivot bar 78, and a lower pivot bar 79, for stabilizing the seat 77 during exercise. As shown by the arrows in FIG. 7, when the user pushes up on the arm assembly 75, this vertical motion pulls upwards on the transmission 50, which then translates to a vertical lift of the upper pivot bar 78 and seat 77. The weight stack 52, may be part of the weight stack assembly 27 for a user not in a wheelchair.

FIG. 10 is a side elevational view of a fourth embodiment of fitness equipment 80 according to the present invention, wherein the fitness equipment 80 is in the nature of a combination lateral pulldown system and a vertical press. FIG. 11 is a rear elevational view thereof; and FIG. 12 is a top plan view thereof. As illustrated in FIGS. 10-12, this embodiment of the fitness equipment 80 is able to accommodate two wheelchairs at a time, for performing two different types of exercises. The fitness equipment 80 has a first side 82 for doing a lateral pulldown and a second side 84 for doing a vertical press.

In the embodiment of FIGS. 10-12, the first side 82 includes an arm assembly 83 that is shaped and positioned to form a lateral pulldown. The arm assembly 83 extends into or adjacent the user space 16, above the wheelchair space 14, so that it may be readily grasped by the user for performing the exercises, without entering into the wheelchair space 14 (and blocking the proper positioning of the wheelchair within the wheelchair space 14). The user in the wheelchair pulls downward on the arm assembly 83 of the first side 82, as shown by the arrows in FIG. 10 and FIG. 12, with the elongated tubular transmission 50 lifting up when the user pulls down on the arm assembly 83. This vertical motion pulls upwards on the weight stack 52. The arm assembly 83, the elongated tubular transmission 50, and weight stack 52 are very similar to that described in the discussion of FIG. 21, below. The arm assembly 83 may include U-shaped tubular grasping elements 86, for performing the exercise of the present embodiment. The weight stack 52, may be part of the weight stack assembly 28 for a user in a wheelchair.

In the embodiment of FIGS. 10-12, the second side 84 includes an arm assembly 85 that is shaped and positioned to form a vertical press. The arm assembly 85 extends into or adjacent the user space 16, above the wheelchair space 14, so that it may be readily grasped by the user for performing the exercises, without entering into the wheelchair space 14 (and blocking the proper positioning of the wheelchair within the wheelchair space 14). The user in the wheelchair pushes upward on the arm assembly 85 of the second side 84, as shown by the arrows in FIG. 10 and FIG. 12, with the elongated tubular transmission 50 lifting up when the user pushes up on the arm assembly 85. This vertical motion pulls upwards on the weight stack 52. The arm assembly 85, the elongated tubular transmission 50, and weight stack 52 are very similar to that described in the discussion of FIG. 21, below.

Figure 14:
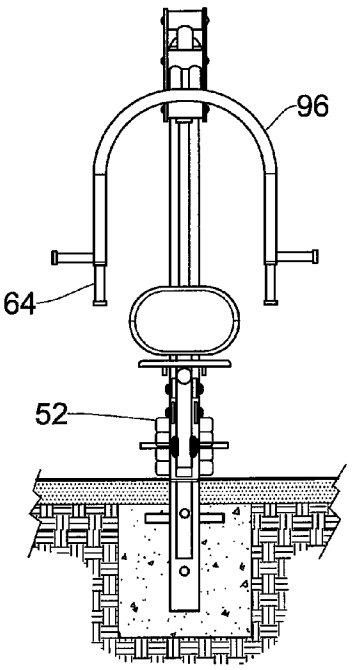
FIG. 14 is a front elevational view thereof.
Figure 13:
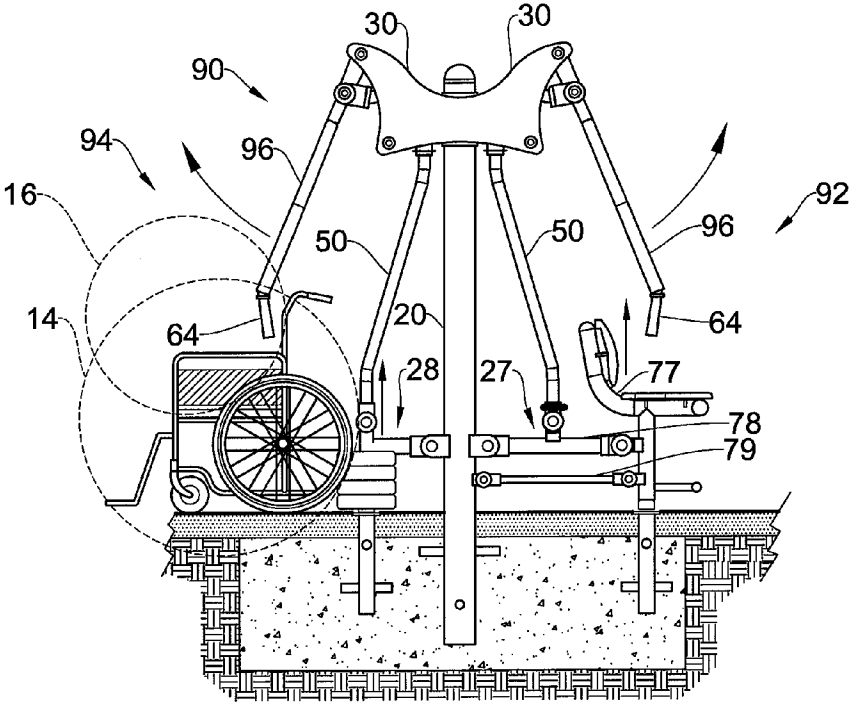
FIG. 13 is a side elevational view of a fifth embodiment of fitness equipment according to the present invention, wherein the fitness equipment is in the nature of a chest press.
Figure 15:
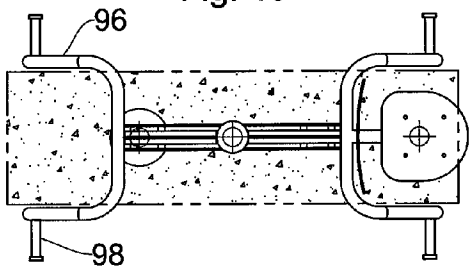
FIG. 15 is a top plan view thereof.

FIG. 13 is a side elevational view of a fifth embodiment of fitness equipment 90 according to the present invention, wherein the fitness equipment 90 is in the nature of a chest press. FIG. 14 is a front elevational view thereof and FIG. 15 is a top plan view thereof. As illustrated in FIGS. 13-15, in this embodiment the fitness equipment 90 includes a first side 94 that is adapted to receive the wheelchair, and a second side 92 that is adapted for use by a user who is not in a wheelchair.

In the embodiment of FIGS. 13-15, the first side 94 includes an arm assembly 96 that is shaped and positioned to form a vertical press. The arm assembly 96 extends into or adjacent the user space 16, above the wheelchair space 14, so that it may be readily grasped by the user for performing the exercises, without entering into the wheelchair space 14 (and blocking the proper positioning of the wheelchair within the wheelchair space 14). The user in the wheelchair lifts upward on the arm assembly 96 of the first side 94, as shown by the arrows in FIG. 13, with the elongated tubular transmission 50 lifting up when the user pushes up on the arm assembly 96. This vertical motion pulls upwards on the weight stack 52. The arm assembly 96, the elongated tubular transmission 50, and the weight stack 52 are very similar to that described in the discussion of FIG. 21, below. The weight stack 52, may be part of the weight stack assembly 28 for a user in a wheelchair. The arm assembly 96 may include L-shaped tubular grasping elements 64, for performing the exercise of the present embodiment.

The second side 92 includes a seat 77 which may be shaped and positioned to support the user for performing the vertical press exercise, an upper pivot bar 78, and a lower pivot bar 79, for stabilizing the seat 77 during exercise. As shown by the arrows in FIG. 13, when the user pushes up on the arm assembly 96, this vertical motion pulls upwards on the transmission 50, which then translates to a vertical lift of the upper pivot bar 78 and seat 77. The weight stack 52, may be part of the weight stack assembly 27 for a user not in a wheelchair.

Figure 17:
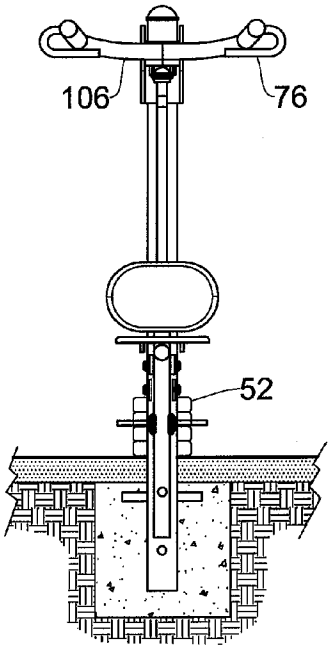
FIG. 17 is a front elevational view thereof.
Figure 16:
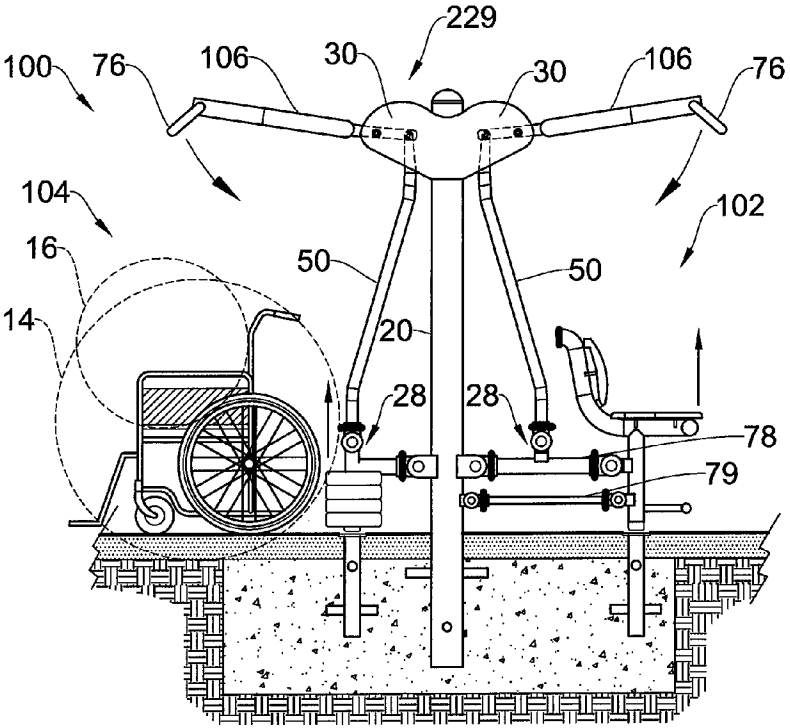
FIG. 16 is a side elevational view of a sixth embodiment of fitness equipment according to the present invention, wherein the fitness equipment is in the nature of a lateral pulldown system.
Figure 18:
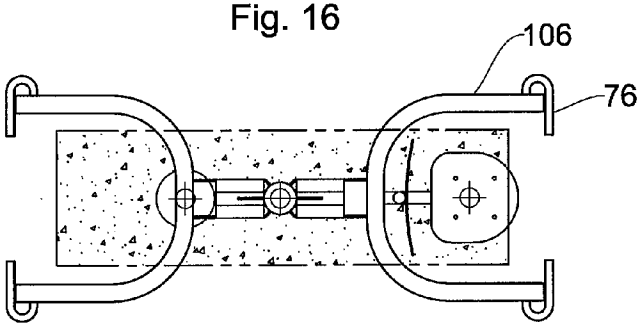
FIG. 18 is a top plan view thereof.

FIG. 16 is a side elevational view of a sixth embodiment of fitness equipment 100 according to the present invention, wherein the fitness equipment 100 is in the nature of a lateral pulldown system. FIG. 17 is a front elevational view thereof and FIG. 18 is a top plan view thereof. As illustrated in FIGS. 13-15, in this embodiment the fitness equipment 100 includes a first side 104 that is adapted to receive the wheelchair, and a second side 102 that is adapted for use by a user who is not in a wheelchair.

In the embodiment of FIGS. 16-18, the first side 104 includes an arm assembly 106 that is shaped and positioned to form a lateral pulldown. The arm assembly 106 is identical on each side of the exercise equipment 100. The arm assembly 106 extends into or adjacent the user space 16, above the wheelchair space 14, so that it may be readily grasped by the user for performing the exercises, without entering into the wheelchair space 14 (and blocking the proper positioning of the wheelchair within the wheelchair space 14). The user in the wheelchair pulls downward on the arm assembly 106 of the first side 104, as shown by the arrows in FIG. 16, with the elongated tubular transmission 50 lifting up when the user pulls down on the arm assembly 106. This vertical motion pulls upwards on the weight stack 52. The arm assembly 106, the elongated tubular transmission 50, and weight stack 52 are very similar to that described in the discussion of FIG. 21, below. The weight stack 52, may be part of the weight stack assembly 28 for a user in a wheelchair. The arm assembly 106 may include U-shaped tubular grasping elements 76, for performing the exercise of the present embodiment.

The second side 102 includes a seat 77 which may be shaped and positioned to support the user for performing the lateral pulldown exercise, an upper pivot bar 78, and a lower pivot bar 79, for stabilizing the seat 77 during exercise. As shown by the arrows in FIG. 16, when the user pulls down on the arm assembly 106, this vertical motion pulls upwards on the transmission 50, which then translates to a vertical lift of the upper pivot bar 78 and seat 77. The weight stack 52, may be part of the weight stack assembly 27 for a user not in a wheelchair.

Figure 20:
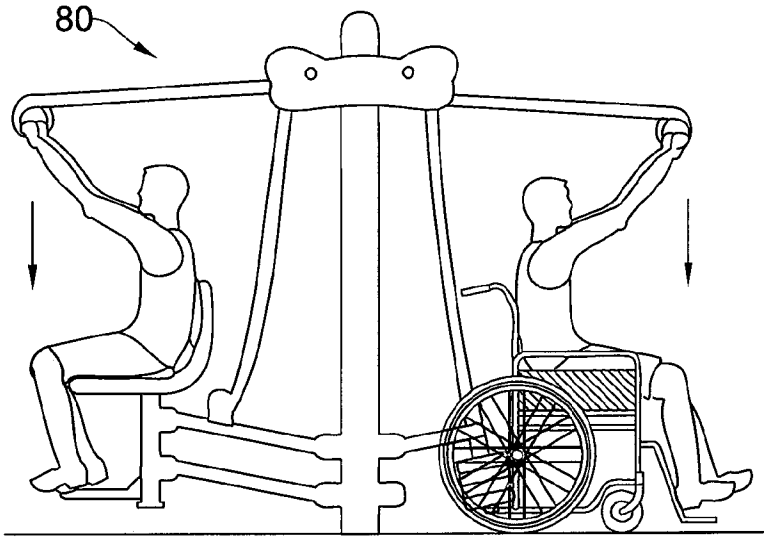
FIG. 20 is a perspective view of a user in a wheelchair and a user not in a wheelchair using the fitness equipment, at an extended position, in an outdoor space.
Figure 19:
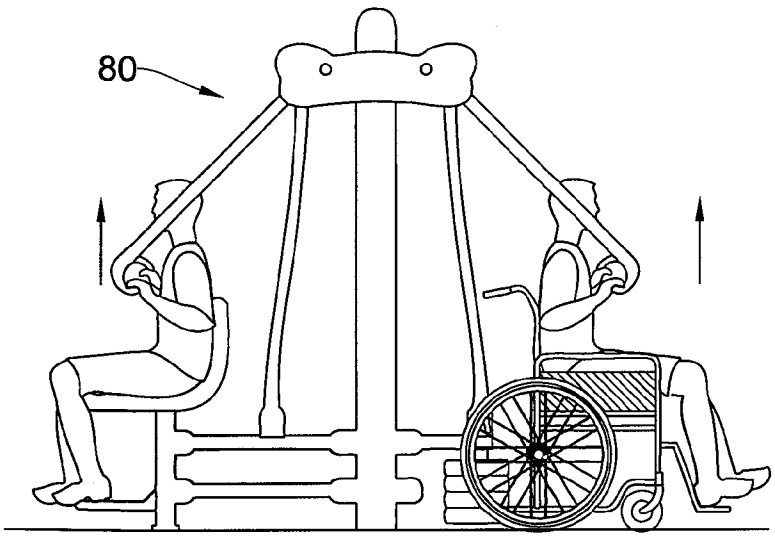
FIG. 19 is a perspective view of a user in a wheelchair and a person not in a wheelchair using the fitness equipment, at a rest position, in an outdoor space.

FIG. 19 is a perspective view of a user in a wheelchair and a user not in a wheelchair using the fitness equipment 80, at a rest position, in an outdoor space. FIG. 20 is a perspective view of a user in a wheelchair and a user not in a wheelchair using the fitness equipment 80, at an extended position, in an outdoor space. The present application also includes a method wherein one or more embodiments described herein may be installed in an outdoor space for the use of users in wheelchairs to perform exercises. As shown in FIGS. 19-20, an outdoor space may be provided which may be accessible to users in wheelchairs. One or more of the embodiments of the fitness equipment 80, described above, may also be provided to be installed in the outdoor space. Finally, the fitness equipment 80 may then be installed in the outdoor space, enabling users in wheelchairs to perform exercises on the fitness equipment 80. While the method described here referred to the fourth embodiment of the fitness equipment 80, any of the above embodiments or their alternatives, or combinations thereof could be used instead or in addition to.

Figure 21:
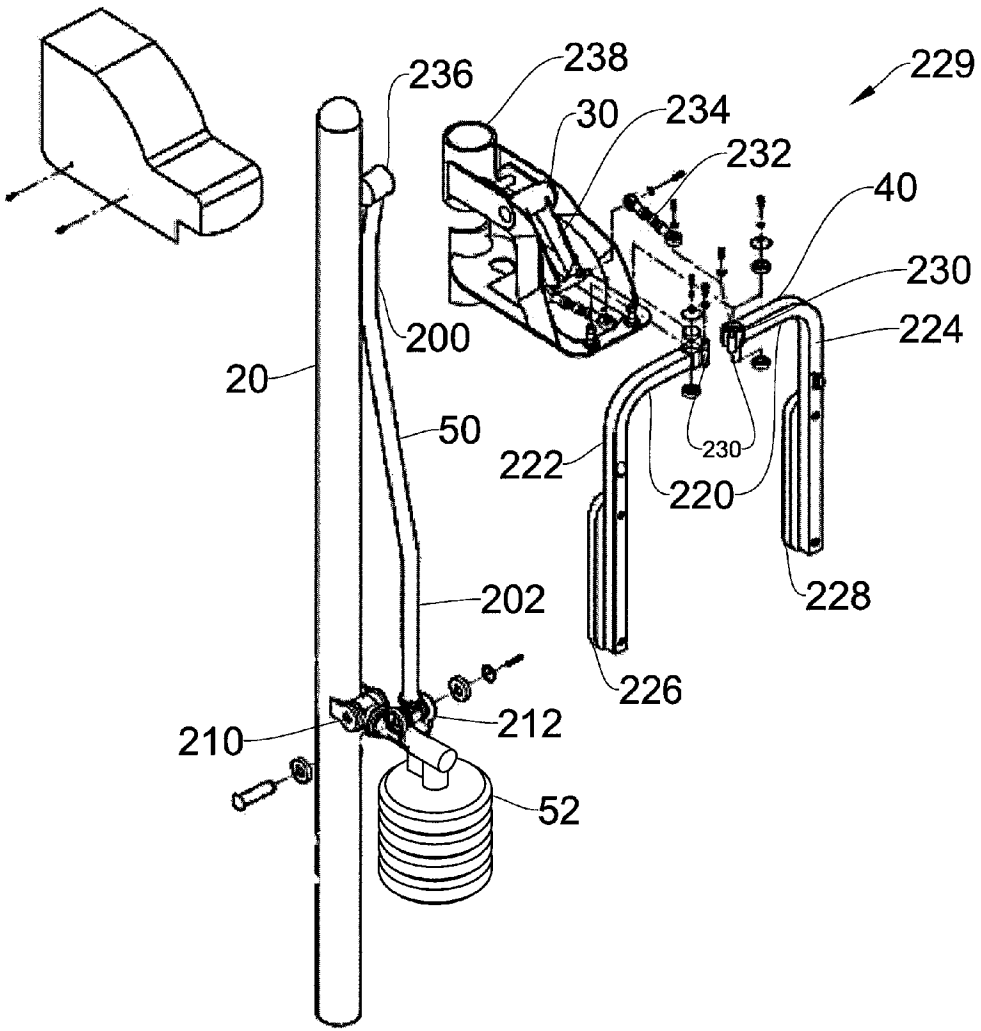
FIG. 21 is an exploded perspective view illustrating a means for translating the motion of an arm assembly to a generally vertical motion of a transmission, according to the embodiment of FIG. 1.

FIG. 21 is an exploded perspective view illustrating the means for converting the motion of the arm assembly 40 to the generally vertical motion of the elongated tubular transmission 50, according to the embodiment of FIG. 1. As used in this application, the term "generally vertical motion" is defined to include any form of motion that lifts the weight stack 52 as described herein. As shown in FIG. 21, the arm assembly 40 may form a U-shaped connection element 220 with a first arm 222 and a second arm 224. The first arm 222 may have a first user interaction surface 226 and the second arm 224 may have a second user interaction surface 228. The first user interaction surface 226 and the second user interaction surface 228 may be horizontal handles, vertical pads, L-shaped handles, or any other type of handle, padding, or grasping, pressing, or pulling surface known to those skilled in the art and required for the particulars of the exercise of a given embodiment.

Each of the arms 222 and 224 is operably connected with the elongated tubular transmission 50 by a means for converting 229 the horizontal motion of the first arm 222 and/or the second arm 224 into a vertical motion of the elongated tubular transmission 50. In this embodiment, the means for converting includes pins 230 mounted on the arms 222 and 224, which are engaged with rods 232 that are attached to a pivot arm 234. The pivot arm 234 is attached to a pivotal attachment element 236 of the elongated tubular transmission 50. In this manner, rotary motion of the arms 222 and/or 224 pulls, via the pins 230, the rods 232, which in turn actuates the pivot arm 234, and raises the elongated tubular transmission 50.

While one embodiment of the means for converting is illustrated in this embodiment, alternative means may also be devised, for this embodiment or for other embodiments. For example, in FIG. 7, another embodiment of the means for converting 229 is illustrated, wherein the arm assembly 75 is attached to the base 20 (or an associated structure mounted on the base 20) with an arm pivot 240. The elongated tubular transmission 50 is attached to the arm assembly 75 via a second arm pivot 242, which is located between the arm pivot 240 and the handle 76. FIG. 16 similarly illustrates another embodiment of the means for converting 229. While some embodiments of the means for converting 229 are illustrated and discussed, those skilled in the art may devise alternative approaches, and such alternatives should be considered within the scope of the present invention.

The elongated tubular transmission 50 may have a first end 200 and a second end 202, and may be connected to the means for converting at a first pivot 210 at the first end 200. The second end 202 may be connected to a weight stack 52 via a pivot 212; and the weight stack 52 may also be connected to the base 20 at a first pivot 210. The arm assembly 62 and means for converting are illustrated in previous figures as well.

Other forms of the weight stack 52 are possible, including coil springs, pulleys, levers, torsion springs, flexible resistance bars, and others known to those skilled in the art. In the embodiments of FIG. 7, FIG. 13, and FIG. 16, the weight stack 52 may be a seat 77, where a portion of the user's weight provides resistance to the motion of the arm assembly 40. In one embodiment, the weight stack for a user in a wheelchair may be a series of weights to simulate the weight of a user. In another embodiment the weight of the user themselves is used to provide resistance. The force required to lift the weight stack 52 may be a set fraction of the weight of the weight stack, which may vary depending on the exact mechanical dimensions of the particular embodiment, or the user, but may be typically about 17%-25% of the weight of the weight stack.

The means for converting the motion of the arm assemblies in the other embodiments are well known to those skilled in the art and are not described in great detail in the present application. In summary, they are generally variations of levers which convert an upward or downward pulling motion of the various arm assemblies to vertical motion of the various elongated tubular transmissions. In some embodiments there may be springs or hydraulic actuators to bring the arm assemblies to their resting position, or additional levers or pivots near the seats for adding strength or stability. Other means for converting may be envisioned by those skilled in the art, and should be considered equivalent and within the scope of the present invention.

While several particular forms of exercise machines are illustrated herein, and several arrangements are made to accommodate both users in wheelchair and not, the invention is intended to include any combination of exercise configurations, whether for one user or more, and for one or more users in wheelchairs. Any exercises known to those skilled in the art may be accommodated using the teachings of the present invention, and any number of users may be accommodated, whether a single unit for a single user, a dual unit as illustrated, or even accommodating three or more, in larger pieces of equipment.

It is also known to those skilled in the art that users in wheelchairs often make use of ramps or platforms for optimal positioning of a wheelchair prior to an activity, and for providing resistance to the exercise. The present invention specifically excludes the use of a wheelchair platform in the wheelchair space for the purpose using the ramp/platform, wheelchair, and user as the resistance. In the present application, the weight stack is the source of resistance to the user in the wheelchair, without a ramp, platform, or the wheelchair itself, being used as part of the resistance as defined in the above embodiments.

Also, the term wheelchair is defined to include not only wheelchairs of the typical sort where the user propels themselves under their own power, but also other chairs or other personal conveyance devices such as electric wheelchairs or scooters for elderly persons. This also includes specialized wheelchairs which may have significantly different shapes than the standard wheelchair, such as racing wheelchairs, etc.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. Fitness equipment installed in or on a ground surface for enabling an exercise by a user in a wheelchair, the fitness equipment comprising:

a base operably installed in or on the ground surface adjacent a wheelchair space that is suitable for receiving the user in the wheelchair;

a frame assembly operably supported by the base such that the frame assembly does not extend into the wheelchair space;

an arm assembly extending from the frame assembly into or adjacent a user space above the wheelchair space, such that the arm assembly does not extend into the wheelchair space, but such that the user in the wheelchair can reach the arm assembly, an elongate tubular transmission having a first end and a second end;

a means for converting a motion of the arm assembly to impart a generally vertical motion to the elongate tubular transmission; and a weight stack operably mounted on the base via a first pivot, and attached to the second end of the elongate tubular transmission by a second pivot, so that the vertical motion of the elongate tubular transmission raises and lowers the weight stack.

2. The fitness equipment of claim 1, wherein the weight stack provides resistance to the movement of the arm assembly, without a ramp, platform, or the wheelchair itself being used as part of the resistance.

3. The fitness equipment of claim 1, wherein the arm assembly has a U-shaped connection element, a first arm operably connected to the U-shaped connection element, a second arm operably connected to the U-shaped connection element, a first user interaction surface operably connected to the first arm, and a second user interaction surface operably connected to the second arm.

4. The fitness equipment of claim 1, further comprising one or more lateral supports connected to the base below the ground surface for increasing the horizontal stability of the fitness equipment.

5. The fitness equipment of claim 1, further comprising a bracing member for providing additional support to the fitness equipment, the bracing member operably connected to the base near the frame assembly and extending into a foundation of the ground surface and having lateral supports connected to the portion of the bracing member within the foundation for increasing the horizontal stability of the fitness equipment.

6. The fitness equipment of claim 3, wherein the means for converting translates a rotational motion of the arm assembly to a vertical motion of the elongated tubular transmission, and wherein the first user interaction surface and the second user interaction surface are both vertical pads for bracing the forearms of the user for performing a butterfly press.

7. The fitness equipment of claim 3, wherein the means for converting translates a rotational motion of the arm assembly to a vertical motion of the elongated tubular transmission, and wherein the first user interaction surface and the second user interaction surface are both L-shaped handles for providing a horizontal or a vertical grip for the user to perform a reverse butterfly press.

8. Fitness equipment installed in or on a ground surface for enabling an exercise by a user in a wheelchair, the fitness equipment comprising:

a base operably installed in or on the ground surface between a first side and a second side;

a first frame assembly operably supported by the base on the first side such that the frame assembly does not extend into a wheelchair space adjacent the base, the first frame assembly comprising:

an arm assembly extending from the frame assembly into or adjacent a user space above the wheelchair space, such that the arm assembly does not extend into the wheelchair space, but such that the user in the wheelchair can reach the arm assembly, an elongate tubular transmission having a first end and a second end;

a means for converting a motion of the arm assembly to impart a generally vertical motion to the elongate tubular transmission; and a weight stack operably mounted on the base via a first pivot, and attached to the second end of the elongate tubular transmission by a second pivot, so that the vertical motion of the elongate tubular transmission raises and lowers the weight stack; and a second frame assembly operably supported by the base on the second side, the second frame assembly comprising:

an arm assembly, a transmission having a first end and a second end;

a means for converting a motion of the arm assembly to impart a generally vertical motion to the transmission; and a seat pivotally mounted on the base, and attached to the second end of the transmission, so that the vertical motion of the transmission raises and lowers the seat.

9. A method for performing exercises, the method comprising the steps of:

providing fitness equipment comprising:

a base;

a frame assembly operably supported by the base such that the frame assembly does not extend into a wheelchair space adjacent the base;

an arm assembly extending from the frame assembly into or adjacent a user space above the wheelchair space, such that the arm assembly does not extend into the wheelchair space, but such that the user in the wheelchair can reach the arm assembly;

a elongate tubular transmission having a first end and a second end;

a means for converting a motion of the arm assembly to impart a generally vertical motion to the transmission; and a weight stack operably mounted on the base via a first pivot, and attached to the second end of the elongate tubular transmission by a second pivot, so that the motion of the transmission raises and lowers the weight stack;

moving in a wheelchair to a location adjacent the base within the wheelchair space;

grasping the arm assembly while seated in the wheelchair; and moving the arm assembly against the bias of the resistance to perform an exercise.

* * * * *